United States Patent [19]

Burkett

[11] Patent Number: 4,493,459

[45] Date of Patent: Jan. 15, 1985

[54] MULTI-PURPOSE CENTRIFUGAL MILL

[76] Inventor: Albert L. Burkett, 1451 E. Glenn, Tucson, Ariz. 85719

[21] Appl. No.: 99,524

[22] Filed: Dec. 3, 1979

[51] Int. Cl.[3] ..... B02C 13/282

[52] U.S. Cl. ..... 241/152 A; 241/154; 241/285 R

[58] Field of Search ..... 241/152 A, 154, 188 R, 241/191, 195, 285 R

[56] References Cited

U.S. PATENT DOCUMENTS

| | | | |
|---|---|---|---|
| 980,048 | 12/1910 | Bercha | 241/152 A |
| 2,700,512 | 1/1955 | Denovan et al. | 241/154 |
| 3,117,735 | 1/1964 | Fourey | 241/154 UX |
| 4,087,052 | 5/1978 | Rohrbach | 241/154 X |
| 4,151,794 | 5/1979 | Burkett | 241/154 X |

*Primary Examiner*—Mark Rosenbaum

*Attorney, Agent, or Firm*—Herbert E. Haynes, Jr.

[57] ABSTRACT

A multi-purpose heavy duty centrifugal mill including a vertically disposed housing to which various frangible materials are fed tangentially to a pre-grinder located in the bore of the housing with the pre-grinder adapted to grind the materials to a predetermined size and direct them to comminution devices for further gradation sizing. The housing is open at the top to freely admit air for aeration of putricidable materials and through which a liquid carrier medium may be introduced.

11 Claims, 5 Drawing Figures

MULTI-PURPOSE CENTRIFUGAL MILL

BACKGROUND OF THE INVENTION

1. Field of the Invention

This invention relates to the treatment of materials and more particularly to a multi-purpose heavy duty centrifugal mill for comminution of various frangible materials such as mined ores, refuse, waste materials and the like.

2. Description of the Prior Art

Many specialized machines have been developed over the years for the comminution of frangible materials such as ball mills for crushing ores and the like. Almost without exception, each machine has been designed to process a particular type of material.

For example, the ever increasing waste disposal problems and interest in the recycling of various materials has in recent years, spurred the design and development of many systems and devices for processing waste and other materials either for more efficient disposal or for recycling purposes. Many elaborate systems and devices have emerged such as the relatively small and simple magnetic separators, air classifiers and the like, all the way to the extremely large processing plants for specialized waste treatment purposes such as automobile crushing and material separating facilities.

In many installations, devices such as the above mentioned air classifiers, magnetic separators, large crushers, and the like are employed in an assembly line like fashion with each device designed to perform a particular function. This technique invariably results in very large and expensive facilities, with the end result being that many locations having relatively low volumes of materials and/or specialized needs simply cannot afford or otherwise justify such installations.

With this in mind, several relatively small and inexpensive machines have been developed for special waste and refuse processing purposes. For example, U.S. Pat. No. 3,987,970 discloses a centrifugal mill for treating solid refuse such as garbage and rubbish of the type normally collected from domestic and relatively small commercial sources. This mill can process such refuse in the dry state with the end product being finely shredded materials suitable for separation and recycling purposes or for increasing the amount of materials which a landfill operation can receive. Further, this mill may treat the solid refuse in conjunction with a fluid carrier medium such as water, aqueous sewage and the like with the end product being a finely shredded pumpable slurry which has been thoroughly aerated to satisfy the biochemical oxygen demand.

Another special purpose centrifugal mill is fully disclosed in U.S. Pat. No. 4,151,794 with this mill being specifically designed to process organic materials such as garbage, animal waste, grass clippings, weeds, cotton stocks, wastes from animal slaughter houses and the like. Depending on the material being process, this mill may be run dry to produce a dry finely shredded end product, may have large quantities of air force fed thereinto for aeration purposes to produce a dry finely shredded odor free product, or may be run simultaneously with air and a liquid carrier medium to produce an odor free pumpable slurry.

The two particular prior art centrifugal mills discussed above are both excellent machines for their intended purposes. However, the first described mill is not particularly well suited for handling the materials that the second described mill is specifically designed to handle and vice versa. This situation is typical in that to the best of my knowledge, no single relatively low cost machine has been devised to process the increasing amounts and great varieties of waste materials and other frangible materials that must be handled.

In view of the above, a need exists for a new and useful multi-purpose heavy duty centrifugal mill which overcomes some of the shortcomings of the prior art.

SUMMARY OF THE INVENTION

In accordance with the present invention, a new and useful multi-purpose centrifugal mill is disclosed for comminution of frangible materials including but not limited to, mined ores, coal, organic and inorganic waste materials, refuse and the like.

The multi-purpose centrifugal mill of the present invention includes as part of the combination, means for feeding the material thereto such as an apron feeder, vibrating plate feeder or a conventional conveyor for feeding relatively small materials on a more or less continuous basis. Relatively large items such as furniture, refrigerators, automobile bodies and the like may be fed to the mill by a suitable crane or similar device. The mill has an especially constructed heavy duty housing which is a vertically oriented multi-sided structure formed of a plurality of dual wall panels and having an input chute in the open top or head thereof for receiving the frangible materials and feeding them tangentially into the bore of the housing. A rotatably driven shaft is concentrically journaled in the housing and the rotating member of a pre-grinding means is affixed to the shaft for rotation therewith adjacent the top thereof. The materials pass downwardly from the input chute under the influence of gravity and into engagement with the pre-grinding means which grinds these materials to a predetermined size. These materials then fall serially into engagement with the rotating portions of comminution means which are fast with and spacially arranged along the length of the shaft. Both the pre-grinding means and comminution means include endless shelf baffles that are mounted in the bore of the housing to grind and impactingly shred the materials for gradation sizing thereof. After passing the last comminution means the sized materials drop into the discharge end at the bottom of the mill and exit tangentially thereof under the influence of a rotating pusher plate carried on the lowermost end of the rotating shaft.

The open top or head section of the mill housing allows air to be freely drawn into the housing which in conjunction with the violent impacting forces will aerate any putricidable materials and expedite the satisfaction of the biochemical oxygen demand to render such materials odor free.

As determined by the nature of the materials being processed, and the desired end product, a liquid carrier medium may be injected into the open head section of the mill simultaneous with the input with the materials being processed. The liquid carrier medium may be water, aqueous sewage, waste liquid hydrocarbons and the like with the results having several advantages in material handling characteristics and alteration of the end product. For example, lightweight products such as paper, sheet plastics and the like can be difficult to process due to the fly away nature thereof, adding a liquid carrier medium will significantly improve the processing of that type of material. The liquid carrier medium may also control the dust which is a problem in such units. When cellular materials are being shredded to make insulation, fireproofing chemicals, insect retarding chemicals and the like may be added to the liquid carrier medium and blended with the cellular materials. When organic materials are being processed to form fertilizers or animal feed, nutrient enriching additives can be added to the liquid carrier medium.

In any event, the centrifugal mill of the present invention is designed to handle virtually any type of frangible materials and produce various output products in dry form or in a pumpable slurry.

Accordingly, it is an object of the present invention to provide a new and improved multi-purpose centrifugal mill.

Another object of the present invention is to provide a new and improved heavy duty multi-purpose centrifugal mill for comminution of virtually any type of frangible material.

Another object of the present invention is to provide a new and improved multi-purpose centrifugal mill including the combination of means for tangentially feeding frangible materials into the head section of a vertically oriented multi-sided housing having a pre-grinding means and comminution means mounted therein.

Another object of the present invention is to provide a new and improved multi-purpose centrifugal mill of the above described character in which the pre-grinding means and the comminution means are designed to grind and impactingly shred the frangible materials to a predetermined size.

Another object of the present invention is to provide a new and improved multi-purpose centrifugal mill of the above described character in which the head section of the mill is open for the free introduction of air and through which a liquid carrier medium may be introduced.

Still another object of the present invention is to provide a new and improved multi-purpose centrifugal mill of the above described type in which the mill housing and the pre-grinding means and the comminution means are of special heavy duty construction.

The foregoing and other objects of the present invention, as well as the invention itself, may be more fully understood from the following description when read in conjunction with the accompanying drawings.

DESCRIPTION OF THE PREFERRED EMBODIMENT

Figure 1:
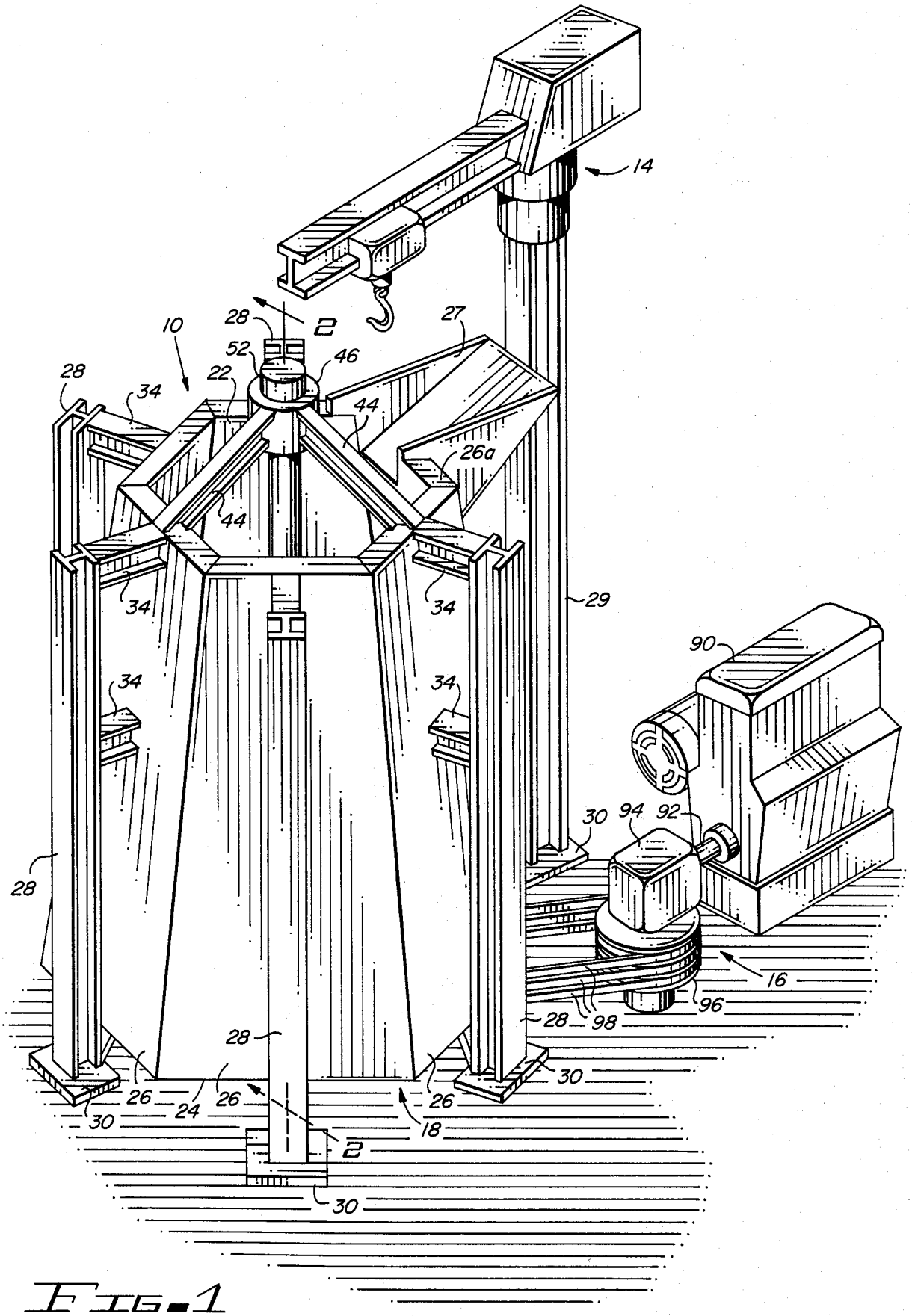
FIG. 1 is a perspective view of the multi-purpose centrifugal mill of the present invention illustrating some of the various features thereof.

Referring more particularly to the drawings, FIG. 1 illustrates the heavy duty multi-purpose centrifugal mill of the present invention which is a combination that includes the main components of the centrifugal mill 10, material feed means 14 and a drive means 16.

The centrifugal mill 10 includes a heavy duty multi-sided housing assembly 18 which is vertically oriented and is provided with a vertical bore 20 extending therethrough between a head or top section 22 and a discharge or bottom section 24. The housing assembly 18 is formed of a plurality of dual wall panels 26 of any desired number such as the specific number of panels shown, which are suitably assembled such as by welding, to provide the housing assembly 18 with the desired cross sectional configuration such as hexagonal, octagonal and the like. The multi-sided configuration of the housing is preferred for ease of fabrication and to provide turbulent internal air flow characteristics for aeration of putricidable materials which may be processed therein.

All of the dual wall panels are identical with the exception of the one panel **26*a* which is substantially the same but differs at its upper end in that it supportingly carries the materials input chute 27. In the preferred embodiment, the materials input chute is tangential with respect to the bore 20 of the housing assembly 18** so that the materials entering the mill will move into engagement with the pre-grinding means as will become apparent as this description progresses.

The multiple panels 26 and **26*a* are configured to be of elongated planar shape, and are assembled so that they diverge downwardly from the head section 22 to the discharge section 24** so that the housing assembly is sized with downwardly increasing cross sectional dimensions.

Figure 2:
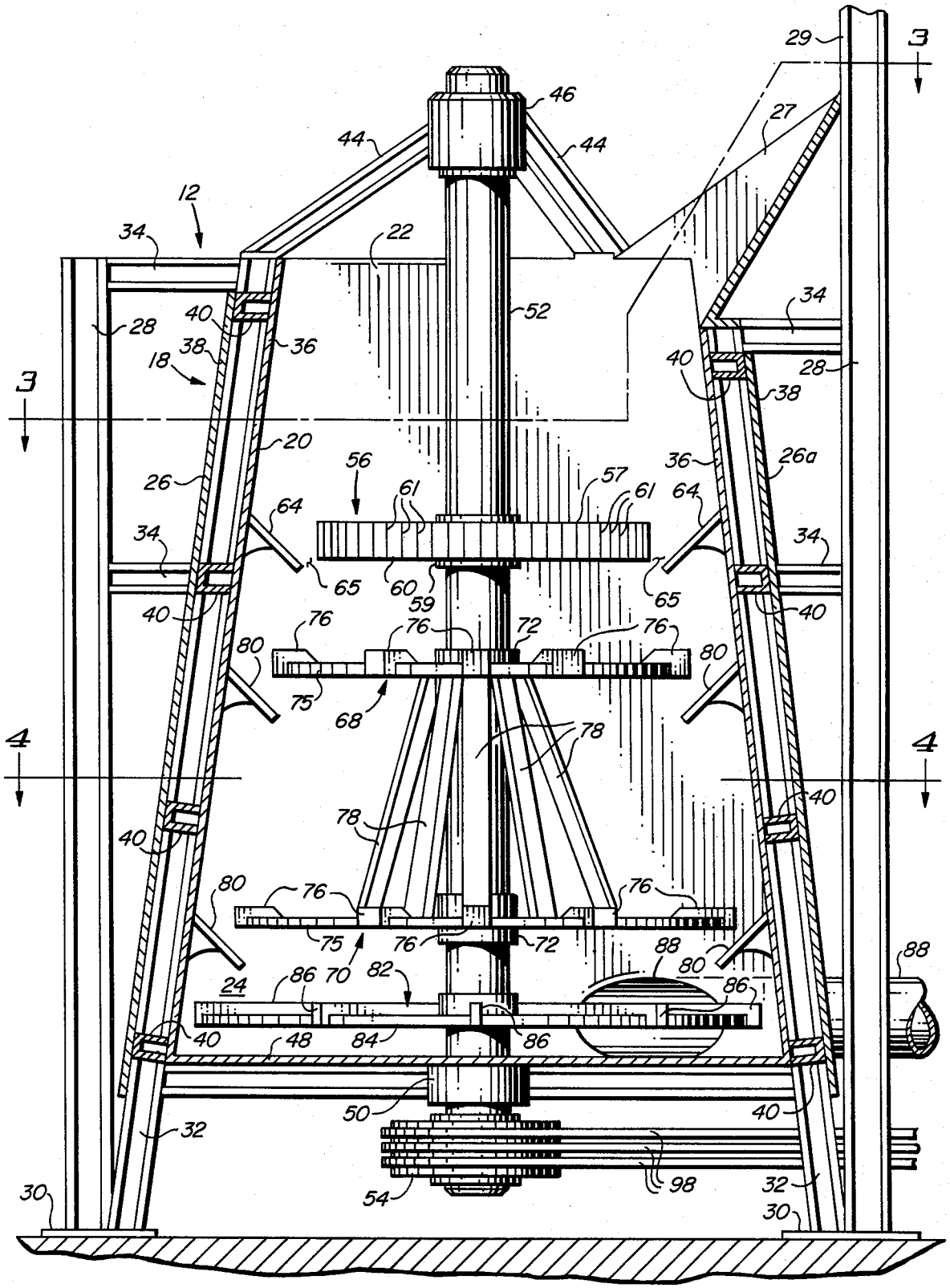
FIG. 2 is an enlarged fragmentary sectional view taken along the line 2—2 of FIG. 1.

Each of the dual wall panels 26 are supported by a different vertical girder 28 with the panel **26*a* being supported by a special girder 29 which is adapted to support one form of the materials feed means 14 as will be explained. The girders 28 and 29 are spaced laterally from the exterior surfaces of their respective panels 26 and 26*a* and each have a foot pad or plate 30 on the lowermost end for anchoring purposes. The foot plates 30 extend from the girders as seen in FIG. 2 for supportive attachment to the lowermost ends of longitudinal beam ribs 32 which extend downwardly from the panels 26 and 26*a* as will be described. The girders 28 and 29 extend upwardly from their respective foot pads 30 and at least one beam strut 34** fixedly extends between the girders and the panels.

As shown in FIGS. 2, 3, 4 and 5, the panels 26 and **26*a* are fabricated with an inner skin 36 and an outer skin 38 which are supported and spaced from each other by at least one of the previously mentioned beam ribs 32 which extend longitudinally of the panels between the skins 36 and 38. In addition to the longitudinal beam ribs 32, each of the panels 26 and 26*a* are provided with at least a pair of beam ribs 40 which extend transversely of the panels between the skins 36 and 38** thereof.

Figure 5:
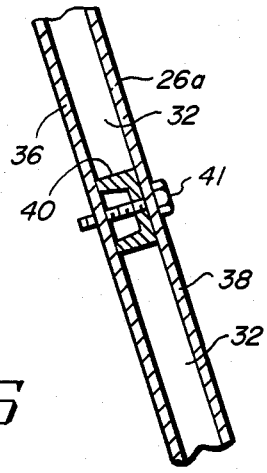
FIG. 5 is a sectional view taken along the line 5—5 of FIG. 4.
Figure 4:
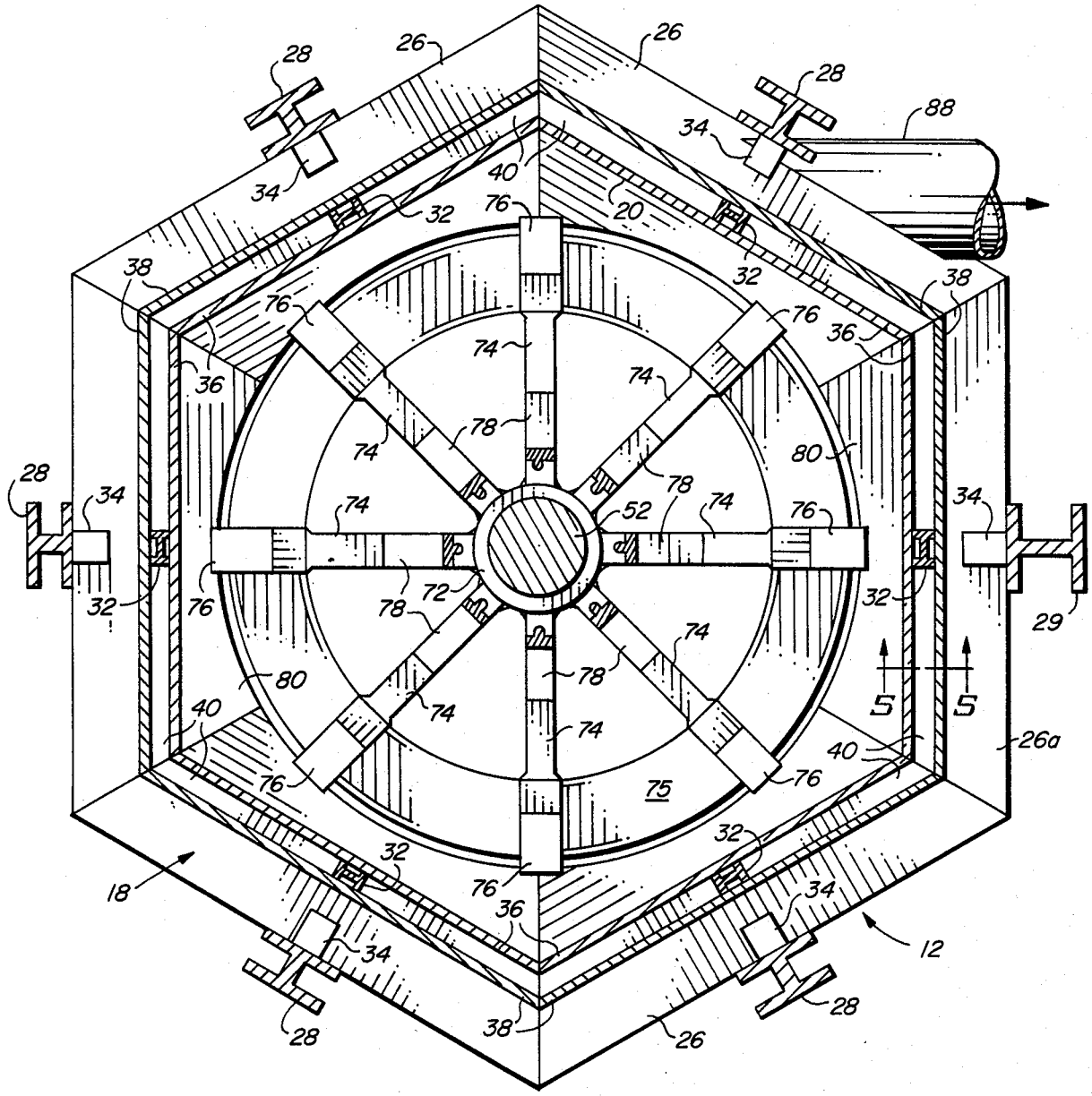
FIG. 4 is an enlarged sectional view taken along the line 4—4 of FIG. 2.

The inner and outer skins 36 and 38, and the longitudinal beam ribs 32 and transverse beam ribs 40 may be welded to form the panels 26 and **26*a* or may be assembled with suitable fastener means such as the bolt 41 shown in FIG. 5**.

As seen in FIGS. 1 and 2, the head section 22 of the mill housing assembly 18 is open, and a plurality of struts 44 extend upwardly and convergingly from the top edges of the housing assembly 18 to supportingly carry a first bearing means 46 at the apex thereof, with that bearing means located coaxial with the bore 20 of the housing 18. The mill housing assembly 18 is provided with a bottom plate 48 which, in addition to forming the floor of the discharge section 24, carries a second bearing means 50 centrally therein which locates the second bearing means coaxial with respect to the first bearing means 46 and therefore, coaxial with respect to the bore 20 of the housing assembly 18.

An elongated shaft 52 is rotatably journaled in the first and and second bearing means 46 and 50, respectively, with the bottom end of the shaft extending through the second bearing means 50 to provide a depending end to which a driven pulley 54 is affixed as will hereinafter be described.

Figure 3:
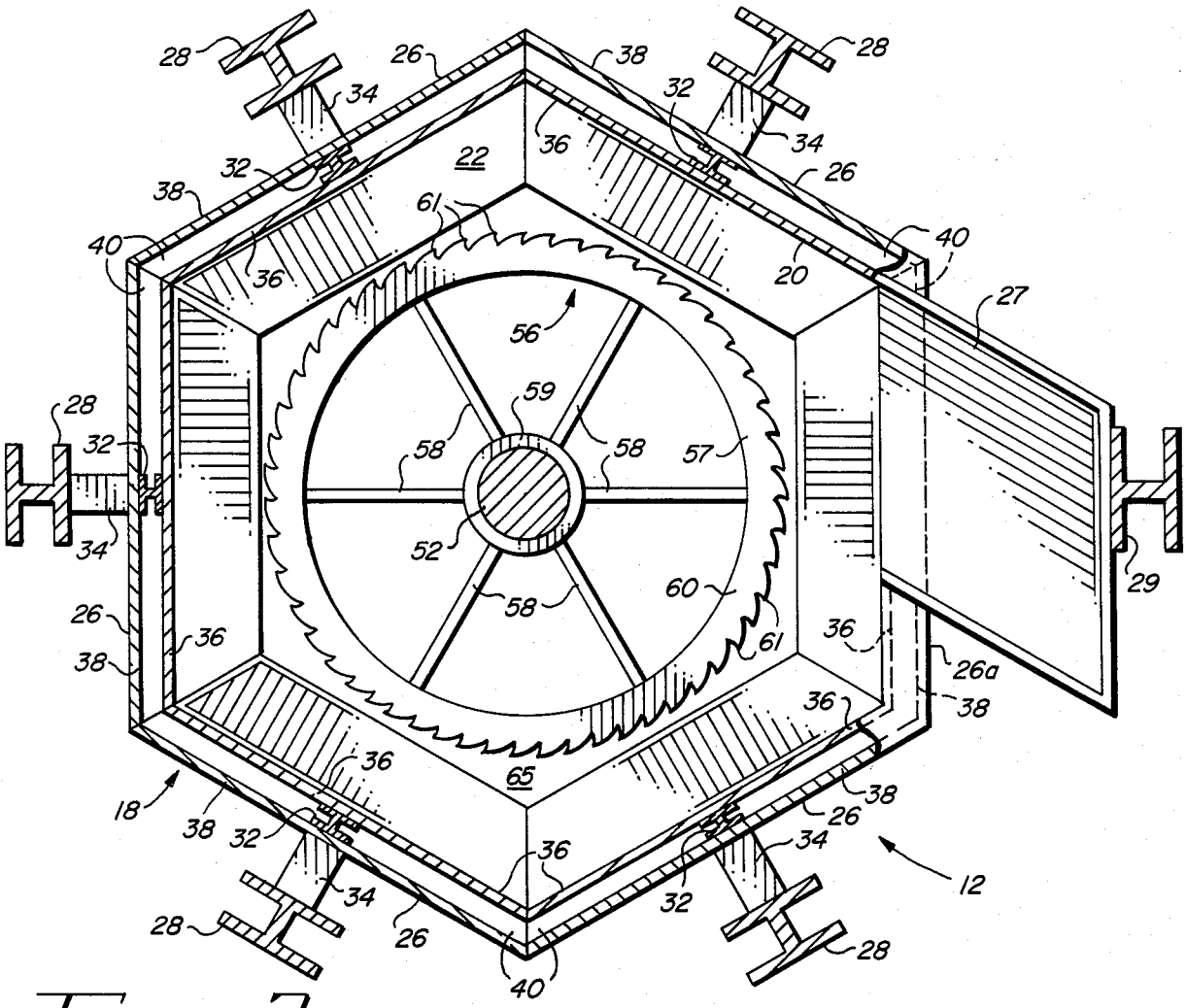
FIG. 3 is an enlarged sectional view taken along the line 3—3 of FIG. 2.

As shown in FIGS. 2 and 3, a pre-grinder means 56 has a portion thereof suitably affixed to the shaft 52 for rotation therewith at a point below the open head section 22 of the housing assembly 18. The pre-grinder means 56 includes a spoked wheel 57 having a suitable hub 59 which is affixed to the shaft 52. A plurality of spokes 58 extend radially from the hub 59 and supportingly carry a circular rim 60 the outer surface of which is provided with grinding teeth 61. The pre-grinding means 56 further includes an endless shelf-like baffle 64 which has a central opening formed therethrough and is affixed in the bore 20 of the housing assembly 18 so as to circumscribe the rim 60 of the pre-grinder wheel 57, and is positioned to form an annular opening 65 between the grinder teeth 61 and the endless inner edge of the shelf baffle 64. As shown in FIG. 2, the shelf baffle 64 is of downwardly and inwardly sloping configuration so that it acts as a funnel in that the annular opening 65 between the shelf baffle and the spoked wheel is of downwardly decreasing size.

The particular configuration of the pre-grinder means 56 will operate on various materials in the following manner. Relatively small materials entering the head section 22 of the mill 10 will fall through the spokes of the pre-grinder wheel 57 and through the annular opening 65 and thus, will be virtually unaffected by the pre-grinder means 56. Larger materials which will not fall through the spokes 58 will be slung outwardly toward the shelf baffle 64 and will slide down through the annular opening 65 as the grinding teeth 61 work thereon to reduce the size to a point where these larger materials can fall through that opening.

The processed materials falling past the pre-grinder means 56 will be roughly sized thereby in the manner described above, and will be funnelled downwardly into the comminution means where they are subjected to violent impacting forces for further gradation sizing. The comminution means includes at least a pair of spaced apart impacting rotors 68 and 70 which are suitably affixed to the shaft 52 for rotation therewith. Although only two impacting rotors are shown, it should be understood that a plurality of such rotors can be employed. The rotors 68 and 70 are identically configured with the exception of size, to accommodate the downardly increasing cross sectional dimensions of the mill housing assembly 18. Therefore, the following detailed description of the impacting rotor 70 will be understood to also relate to the rotor 68.

The materials impacting rotor 70 comprises a central hub 72 which is suitably affixed to the shaft 52. A plurality of striker bars 74 extend radially from the hub in spoke-like fashion and have their outermost ends affixed to a ring plate 75. The outermost ends of the striker bars 74 are configured with relatively enlarged striker blocks 76 formed thereon which extend upwardly from the surface of the ring plate 75 and extend somewhat beyond the periphery thereof. The enlarged striker blocks 76 contribute significantly to the fly wheel effect of the rotor and exert considerable shredding and impacting forces on the materials being processed in the mill 10. Each of the radial striker bars 74 is provided with an angularly upwardly and inwardly extending strut 78 the upper end of which is fixedly attached to the hub 72 of the impacting rotor immediately thereabove, which in the illustrated embodiment is the rotor 68. These struts 78 add to the structural rigidification of the rotors and will strike downwardly moving materials causing them to be thrown outwardly into the areas of the striker blocks 76. Further, the struts 78 will inhibit a materials buildup from occurring proximate the shaft 52 and will prevent the materials from falling through the central opening of the ring plate 75.

Each of the impacting rotors 68 and 70 is provided with an endless shelf-like baffle 80 which forms part of the comminution means. The shelf-like baffles 80 are configured and positioned for the same purpose as the previously described shelf baffle 64.

It may now be seen that the movement of materials downwardly through the centrifugal mill 12 will first subject those materials to the grinding forces exerted by the pre-grinder means 56 unless the materials are smaller than the size which is determined by the annular opening 65 between the pre-grinder means and the shelf baffle 64. The materials are then subjected to shredding and impacting forces by the comminution means and will then drop downwardly into the discharge section 24 of the mill 10. The processed materials will be in a finely shredded and pulverized state with the actual size being determined by the nature of the materials being processed and the number of impacting rotors provided in the mill 10.

The processed materials falling into the discharge section 24 of the mill will be funnelled downwardly and inwardly by the comminution means immediately thereabove onto a pusher plate 82 which is attached to the shaft 52 immediately above the floor plate 48 of the mill. The pusher plate 82 includes a circular disc 84 having a plurality of upstanding radial bars 85 thereon which push the materials out of the mill through a tangential outlet port 88 provided for that purpose.

As seen in FIGS. 1 and 2, the drive means 16 preferably includes an internal combustion engine 90 the output shaft 92 of which drives a suitable gear box 94 which in turn drives a pulley 96. A plurality of belts 98 serve to couple the drive pulley 96 with the driven pulley 94 that is mounted on the depending end of the shaft 52 as hereinbefore described. Although the drive means 16 is shown and described as being an internal combustion engine, it will be understood that any suitable drive means may be employed, such as an electric motor (not shown).

The materials feeding means 14 may be any mechanism suitable for delivering specific types of materials to the mill. For example, if coal is being processed an apron feeder (not shown) may be employed. As shown in FIG. 1, the feed means 14 may be in the form of a crane suitable for feeding large materials such as automobile bodies, refrigerators, and the like to the mill.

The crane is preferably supported on the uppermost end of the special girder 29 so as to be proximate the input chute 27 of the mill and the crane is operable in the manner well known in the art.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A multi-purpose centrifugal mill for comminution of frangible materials comprising:

(a) a housing assembly having an upper end which defines a head section and a lower end which defines a bottom discharge section and having a vertical bore, said housing having a tangential output port in the bottom discharge section thereof;

(b) a materials input chute formed at the head section of said housing assembly and disposed tangentially of the bore thereof;

(c) grinding means in the head section of said housing assembly for receiving the frangible materials from said input chute and grinding those materials to an approximate predetermined size, said grinding means including, I. a wheel rotatably journaled in said housing and having grinding teeth formed on the periphery thereof, II. an endless shelf baffle having a central opening, said shelf baffle mounted in the bore of said housing concentric with said wheel, III. said wheel and the concentric opening of said shelf baffle being sized to form an annular opening therebetween which determined the approximate size of the materials which may pass therethrough; and (d) comminution means in the bore of said housing assembly below said grinding means for receiving the frangible materials therefrom and exerting comminution forces thereon.

2. A multi-purpose centrifugal mill as claimed in claim 1 wherein the upper end of said housing is open to admit air into the bore thereof for aeration of the materials comminuted therein.

3. A multi-purpose centrifugal mill as claimed in claim 1 wherein the upper end of said housing is open to admit air and through which a liquid carrier medium may be introduced into the bore of said housing.

4. A multi-purpose centrifugal mill as claimed in claim 1 wherein said housing assembly is a multi-sided structure formed of a plurality of dual wall panels which are assembled so as to diverge downwardly from the upper end to the bottom end of said housing assembly.

5. A multi-purpose centrifugal mill as claimed in claim 4 wherein each of said dual wall panels has an inner skin and an outer skin which are spaced apart and supported on at least one beam rib.

6. A multi-purpose centrifugal mill as claimed in claim 4 wherein each of said dual wall panels is of elongated planar configuration with an outer skin and an inner skin that are spaced from each other and supported on at least one longitudinal beam rib and at least a pair of transverse beam ribs.

7. A multi-purpose centrifugal mill as claimed in claim 4 wherein said housing assembly is supported by a plurality of upright girders with there being one of said girders for each of said dual wall panels, each of said girders spaced from the exterior surface of its respective one of said dual wall panels and having at least one beam strut fixedly extending therebetween.

8. A multi-purpose centrifugal mill as claimed in claim 7 and further comprising means for feeding the frangible materials to said input chute with said means being supported on the upper end of at least one of said girders.

9. A multi-purpose centrifugal mill for comminution of frangible materials comprising:

(a) a housing assembly having an upper end which defines a head section and a lower end which defines a bottom discharge section and having a vertical bore, said housing having a tangential output port in the bottom discharge section thereof;

(b) a materials input chute formed at the head section of said housing and disposed tangentially of the bore thereof;

(c) grinding means in the head section of said housing for receiving the frangible materials from said input chute and grinding those materials to an approximate predetermined size, said grinding means including, I. a wheel rotatably journaled in the bore of said housing and including, a hub, a plurality of spokes extending radially from said hub in predetermined angular increments which determine the size of the materials which may pass therebetween, an endless rim coaxial with said hub and fixedly attached on the extending ends of said spokes, grinding teeth formed on the periphery of said endless rim, II. an endless shelf baffle mounted in the bore of said housing so as to circumscribe said wheel, said shelf baffle having a central opening and configured to slope angularly downwardly and inwardly to the central opening thereof which is located so as to form an annular opening between said endless rim and said shelf baffle with the size of that annular opening determining the approximate size to which the frangible materials will be ground by said grinding means; and (d) comminution means in the bore of said housing below said grinding means for receiving the frangible materials therefrom and exerting comminution forces thereon.

10. A multi-purpose centrifugal mill for comminution of frangible materials comprising:

(a) a housing assembly having an upper end which defines a head section and a lower end which defines a bottom discharge section and having a vertical bore, said housing having a tangential output port in the bottom discharge section thereof;

(b) a materials input chute formed at the head section of said housing and disposed tangentially of the bore thereof;

(c) grinding means in the head section of said housing for receiving the frangible materials from said input chute and grinding those materials to an approximate predetermined size; and (d) comminution means in the bore of said housing below said grinding means for receiving the frangible materials therefrom and exerting comminution forces thereon, said comminution means comprises at least a pair of materials impacting rotors coaxially spaced in the bore of said housing assembly and journaled for rotation therein, said pair of impacting rotors having a plurality of strut means interconnectingly extending therebetween.

11. A multi-purpose centrifugal mill as claimed in claim 10 wherein each of said pair of materials impacting rotors comprises:

(a) a central hub;

(b) a plurality of striker bars extending radially from said hub;

(c) a ring plate concentric with said hub and fixedly carried on the extending ends of said plurality of striker bars; and (d) said striker bars each having an enlarged striker block formed on its extending end.

* * * * *